United States Patent [19]

Cermanov et al.

[11] Patent Number: 4,641,791

[45] Date of Patent: Feb. 10, 1987

[54] APPARATUS FOR MATERIAL GRINDING

[75] Inventors: Atanas S. Cermanov; Ljubomir R. Kazarov; Marco S. Valev; Jelyazco C. Jelyazcov; Rusy C. Kolev, all of Stara Zagora, Bulgaria

[73] Assignee: N P S P "Desintegrator", Stara Zagora, Bulgaria

[21] Appl. No.: 733,623

[22] Filed: May 13, 1985

[30] Foreign Application Priority Data

May 11, 1984 [BG] Bulgaria ..... 65474

[51] Int. Cl.[4] ..... B02C 13/10

[52] U.S. Cl. ..... 241/66; 241/154; 241/188 A

[58] Field of Search ..... 241/65, 66, 67, 261.2, 241/261.3, 152 A, 188 A, 154

[56] References Cited

U.S. PATENT DOCUMENTS 2,591,966 4/1952 Rider ..... 241/66 X

FOREIGN PATENT DOCUMENTS 902807 2/1982 U.S.S.R. .

*Primary Examiner*—Mark Rosenbaum

[57] ABSTRACT

Apparatus for grinding materials, particularly sticky materials of organic and inorganic origin. The apparatus has a cylindrical casing in which, along its axis, a rotor in the shape of a disc mounted, the disc being driven by a prime mover. The disc has evenly distributed along its circumference on both of its sides. One of the openings in the casing is closed by a fixed front cover having a receiving neck, disposed along its axis and counter-pins designed on the inside of the casing and evenly distributed along a circumference. A ground material discharge opening is disposed between the disc and a back cover for the casing. The rotor is enveloped by a bushing firmly fixed to the casing and longitudinal races are disposed on the side of the rotor, and on the external side circumference cooling closed races are located.

3 Claims, 3 Drawing Figures

APPARATUS FOR MATERIAL GRINDING

This invention relates to a device for the grinding of materials; it finds application in the grinding of sticky materials of organic and inorganic origin which in a normal air medium become compact and compressed.

An apparatus for material grinding is known (Certificate of authorship of the USSR No. 902,807), which consists of a horizontal cylindrical casing in which a rotor driven by an electric motor is fitted coaxially. The rotor has the shape of a disc mounting pins which are evenly positioned on both of its sides. One of the holes in the casing is closed by a fixed cover having pins evenly positioned along a circumference on the inside of the casing. A receiving neck having an adjustment valve is designed along the front cover axis. Another hole of the casing, on the electric motor side, is closed by a fixed back cover. A third discharge hole is disposed between the disc and the back cover in the casing.

A defect of this known apparatus for material grinding is its poor grinding due to the limited area in which grinding occurs. This demands the use of additional separation necessitating complex equipment, and secondary grinding of the separated coarse-grained materials.

The object of this invention is to provide a device for the grinding of materials which intensifies the grinding process, thus avoiding the necessity of additional separation.

This object is achieved by the apparatus for grinding of materials in accordance with the invention. Such apparatus consists of a horizontal cylindrical casing along the axis of which there is fitted an electric motor a rotor having the shape of a disc driven by the motors, the disc having pins evenly distributed along its circumference on both sides. One of a number of holes in the casing is closed by a fixed front cover having a receiving neck fitted along its axis; counter-pins disposed on the inner side of the housing are also evenly distributed along the circumference. Another hole in the casing, on the electric motor side, is closed by a fixed back cover, and further, discharge hole is located between the disc and the back cover. According to this invention, the rotor is enveloped by a bushing fixed to the housing in which, on the rotor side, there are longitudinal races. Circumferentially closed cooling races are machined in the body of the casing on its external side. A common concentric rectangular race is machined in the back cover, on the inside of the casing and in a bushing firmly fixed to this cover, connected to the outside space by six evenly positioned input radial races machined in the back cover, and secured to the inner casing space by 6 evenly spaced output radial races machined in the bushing.

The advantages of the apparatus for material grinding according to this invention are that it intensifies the grinding process, thus resulting in the elimination of any need for secondary separation and grinding.

A preferred example of the invention is shown on the attached figures, wherein.

Figure 1:
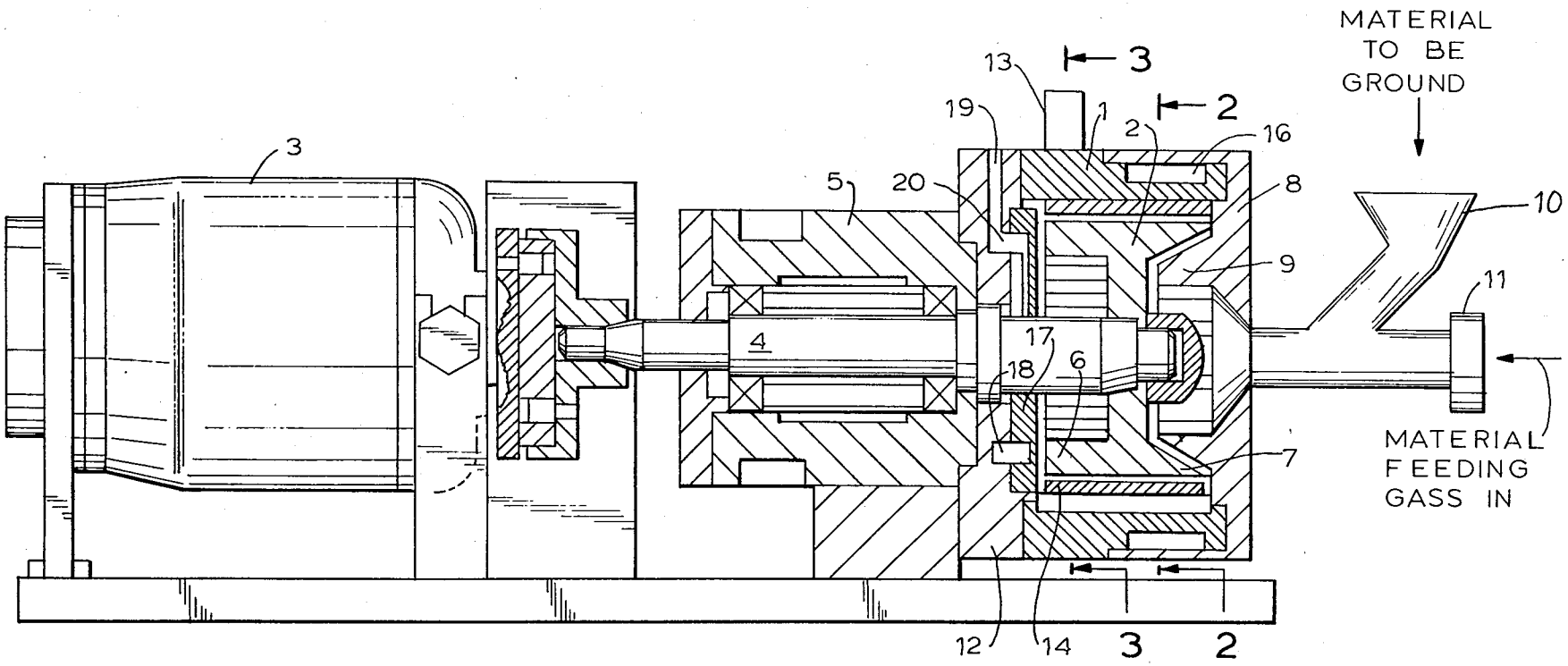
FIG. 1 is a longitudinal section of the device.

The apparatus for grinding materials of the invention consists of horizontal cylindrical casing 1 in which a rotor 2 is coaxially fitted, the rotor being driven by an electric motor 3. The shaft 4 of rotor 2 is mounted in a bearing case 5. Rotor 2 is in the shape of a disc having, on both of its sides, evenly positioned on a circumference inner pins 6 and outer pins 7. One of a number of holes of the casing 1 is closed by a fixed cover 8 having counter-pins 9 evenly positioned along a circumference on the inside of the casing 1 which are fitted radially within the external pins 7 at some distance from them. A receiving neck 10 with a regulation valve 11 is disposed along the axis of the front cover 8. Another hole in casing 1, on the bearing case 5 side, is closed by a fixed back cover 12 aligned with it. A discharge hole 13 is located between the disc and the back cover 12 in the casing 1.

Figure 2:
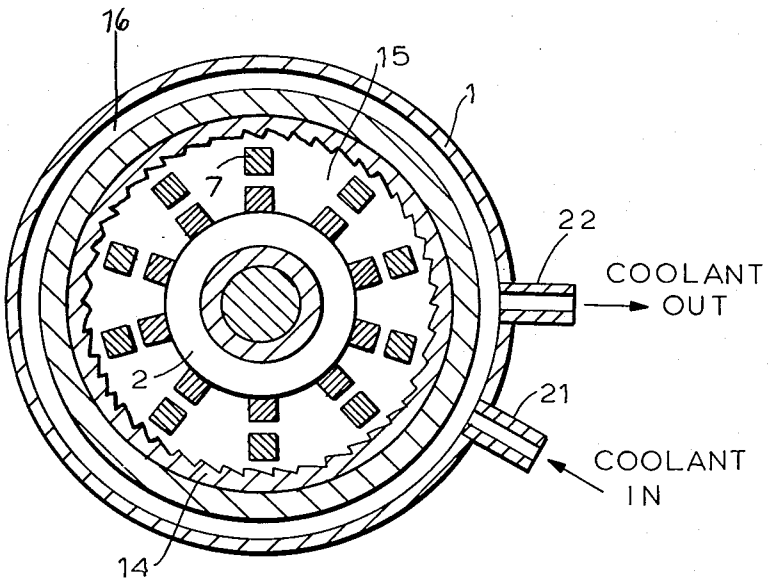
FIG. 2 is a section taken along the line 2—2 in FIG. 1.
Figure 3:
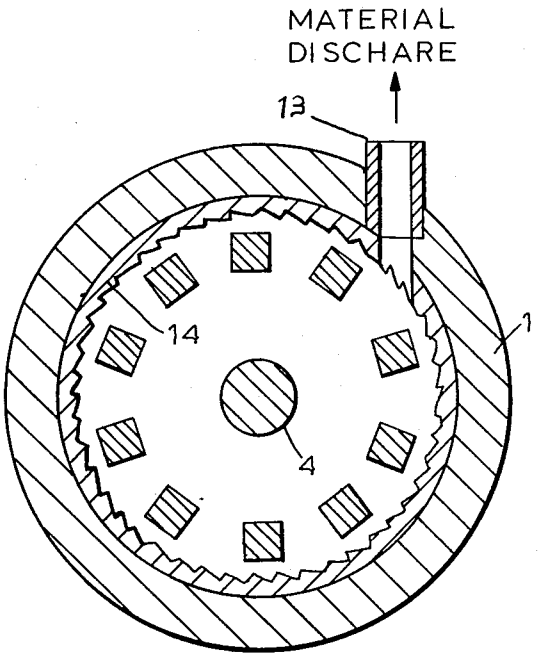
FIG. 3 is a section taken along the line 3—3 in FIG. 1.

Rotor 2 is secured by a firmly fixed bushing 14 to the casing 1, where longitudinal channels 15 of different geometrical shapes are disposed on the side of the rotor 2. A circumferentially closed cooling race 16 connected to recirculation cooling fluid are machined in the body of casing 1, on its external side. Cooling fluid enters race 16 through pipe 21 (FIG. 2) and is discharged from it through pipe 22. A common concentric rectangular race 18 for feeding the fluid and forming a protection screen for the bearing case 5 is machined on the back cover 12, on the inside of casing 1, and in bushing 17, which is firmly fixed to the back cover 12. Bushing 17 is connected to the external space by means of six input radial races 19 evenly positioned and machined in back cover 12, and to the internal space of casing 1, by six outgoing radial races 20 machined in bushing 17. Pins 6 and 7 of rotor 2 and counter-pins 9 of the front cover 8 can have any geometrical shape depending on the requirements for grinding different types of materials.

The operation of the apparatus for grinding materials according to this invention, is as follows: Electric motor 3 actuates rotor 2. The material to be ground enters from receiving neck 10 and is transported with the required amount of air or gas regulated from valve 11. As a result of the impact effect on the particles the initial grinding occurs after which, under the effect of the ventilation effect established by external pins 7 of rotor 2, the material enters between rotor 2 and bushing 14 where the secondary grinding occurs. As a result of the impact and grinding effect in the races of bushing 14, the material then enters the space limited by back cover 12 and rotor 2 where the fine grinding occurs. The material is then discharged from the apparatus through hole 13. The desired grain size of the ground material can be produced depending on the changes of the kinematic and geometrical parameters of the operating elements of the apparatus. During the grinding process, fluid (air) is fed through the input radial canals 19 serving as protection screen for bearing case 5.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. An apparatus for grinding materials comprising a cylindrical casing in which, along its axis, a rotor in the shape of a disc is mounted, the disc being driven by a prime mover and having pins evenly distributed along its circumference on both of its sides, the casing having a plurality of holes in it, one of the holes in the casing being closed by a fixed front cover having a receiving neck disposed along its axis, counter-pins located on the inside of the casing and evenly distributed along its circumference, another casing hole, on the prime mover side of the casing, being closed by a fixed back cover, and an outgoing hole in the casing disposed between the disc and the back cover, a first bushing enveloping the rotor, the first bushing being firmly fixed to the casing and having longitudinal races located on the rotor side, circumferentially closed cooling races on the external side of the casing and on the radially outer side of the bushing, and on the inside of the casing in a second bushing firmly fixed to the back cover there is provided a common concentric rectangular coolant receiving race connected to the atmosphere by a plurality of spaced output radial races disposed in the back cover, the common coolant receiving race being connected to the inner space of the casing by a plurality of evenly spaced outgoing radial races located in the bushing.

2. The apparatus of claim 1, wherein the cylindrical casing is disposed horizontally.

3. The apparatus of claim 2, wherein the casing and electric motor are disposed coaxially and are mounted upon a common support.

* * * * *